US005649270A

United States Patent [19]

Omata et al.

[11] Patent Number: 5,649,270

[45] Date of Patent: Jul. 15, 1997

[54] DEVELOPER CONTAINER WITH LOW SHUTTER OPENING/CLOSING RESISTANCE

[75] Inventors: Kazuhiko Omata, Satte; Toshiaki Nagashima; Kyota Miyazaki, both of Yokohama, all of Japan

[73] Assignee: Canon Kabushiki Kaisha, Tokyo, Japan

[21] Appl. No.: 543,619

[22] Filed: Oct. 16, 1995

[30] Foreign Application Priority Data

Oct. 18, 1994 [JP] Japan ..... 6-278465

[51] Int. Cl.[6] ..... G03G 15/08

[52] U.S. Cl. ..... 399/262; 141/364

[58] Field of Search ..... 355/260; 414/411; 141/364; 206/816; 222/160, 325, DIG. 1

[56] References Cited

U.S. PATENT DOCUMENTS 5,491,542 2/1996 Nagashima et al. ..... 355/260

FOREIGN PATENT DOCUMENTS 2-73382 3/1990 Japan .

OTHER PUBLICATIONS

Patent Abstracts of Japan, vol. 14, No. 264, Jun. 7, 1990.

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

A developer container includes a container portion having an opening through which developer is supplied in or out; a shutter member for opening and closing the opening; a slide-guide for guiding the shutter member; a recess on a surface of the slide guide on which the shutter member slides.

19 Claims, 7 Drawing Sheets

DEVELOPER CONTAINER WITH LOW SHUTTER OPENING/CLOSING RESISTANCE

FIELD OF THE INVENTION AND RELATED ART

The present invention relates to a developer container from which developer is refilled into an image forming apparatus such as a copying machine or printer employing the electro-photographic system or electrostatic recording system.

Conventionally, powder toner is used as developer in an image forming apparatus such as an electrostatic copying machine or printer. After the developer in the apparatus itself is consumed, toner is refilled into the main assembly of the image forming the apparatus (hereinafter, apparatus main assembly), using a refill toner container. This refill toner container is constituted of an actual container portion and a seal portion. The actual container portion is generally formed of synthetic resin or the like, and is cylindrical, parallelepedic, or of a like shape. The seal portion seals the opening of the container portion, through which powder toner is refilled from the container portion to the developing apparatus of the image forming apparatus.

Most of the conventional seals are generally formed of easy-peel type film. They are pasted to the periphery of the opening of the container portion, using adhesive, or means such as heat sealing. In order to expose the opening, the pasted portion of the film is peeled off. In the case of this system, however, the container portion cannot be sealed after toner is discharged; therefore, the toner remaining in the container sometimes falls out and scatters.

Therefore, a refill developer container with a sliding shutter has been proposed in U.S. patent applications Ser. No. 08/254,760, which issued as U.S. Pat. Nos. 5,491,542, and 08/265,937, filed Jun. 27, 1994.

This container comprises: a reciprocative sliding shutter; a cap member for guiding the shutter placed at the opening of the container portion; and a seal member, which is disposed between the shutter and cap member so that the container portion remains sealed. As the sliding shutter is moved, the opening of the container portion is exposed, allowing the toner in the container portion to be refilled into the apparatus main assembly. After toner is refilled into the apparatus main assembly, the shutter can be closed to reseal the container portion so that the container can be separated from the apparatus main assembly without scattering the toner, even when a small amount of toner still remains in the container. As for the material for the seal member for the sliding shutter, elastic material such as foamed polyurethane, foamed polyethylene, various rubbers, or rubber sponge can be used. It is disposed, being compressed, between the shutter and cap member to keep the container portion sealed.

In recent years, there has been a tendency to reduce the toner particle diameter to an extremely small size, in order to improve image quality. As a result, toner is liable to scatter more easily compared to the conventional toner; therefore, better sealing properties far exceeding those of the conventional container are required at the shutter portion.

In addition, in order to address the ecological issue of reducing the number of refill developer containers, that is, the so-called toner bottle, which is necessary for refilling toner, in order to improve the operational properties of the apparatus by means of reducing the number of times toner has to be refilled, and in order to reduce cost, there has been a tendency to increase the capacity of the refill developer container. Consequently, there has been a tendency to enlarge the toner refilling opening in order to maintain toner refill efficiency. In this case, the larger the refill opening becomes, the more liable to occur the toner leak and toner scattering are, when the refill toner container is transported, or in particular, when it is dropped. Therefore, sealing properties have been required to be improved in proportion to the size of the opening.

Realization of such a high level of sealing properties results in higher sealing pressure between the shutter and opening; therefore, the force necessary to open the shutter increases.

Further, when an elastic seal is mounted on the shutter, it is liable that a suction effect will occur, causing the elastic seal to stick to the surface on which it slides, further increasing the force necessary to open the shutter.

SUMMARY OF THE INVENTION

The primary object of the present invention is to provide a developer container with a high level of sealing properties, capable of preventing developer from leaking upon impact.

Another object of the present invention is to provide a developer container capable of reducing the force necessary to open or close the shutter which seals the container opening.

A further object of the present invention is to provide a developer container capable of preventing the shutter from sticking to the surface on which it slides.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Figure 1:
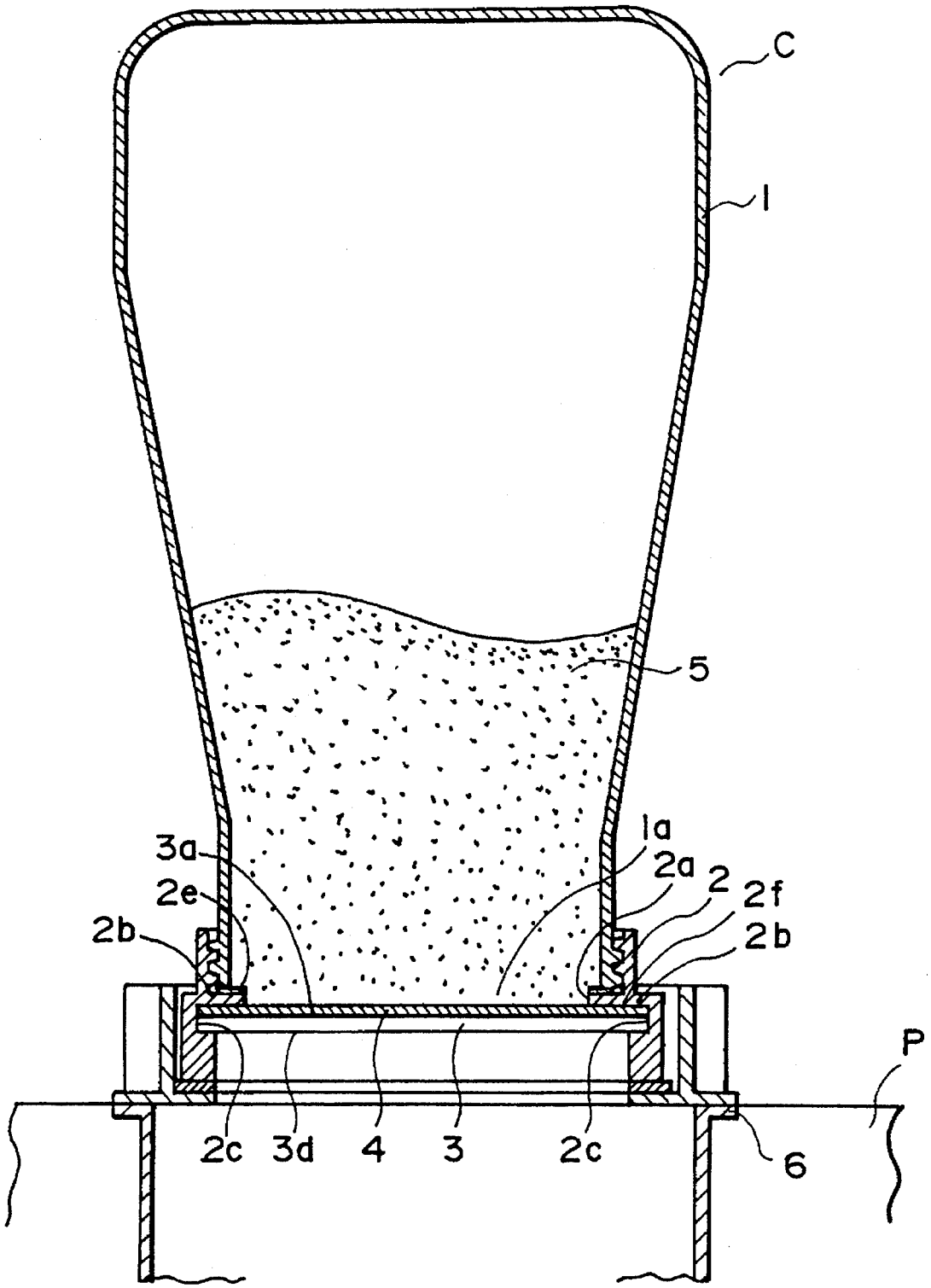
FIG. 1 is a sectional side view of an embodiment of the refill developer container in accordance with the present invention.
Figure 2:
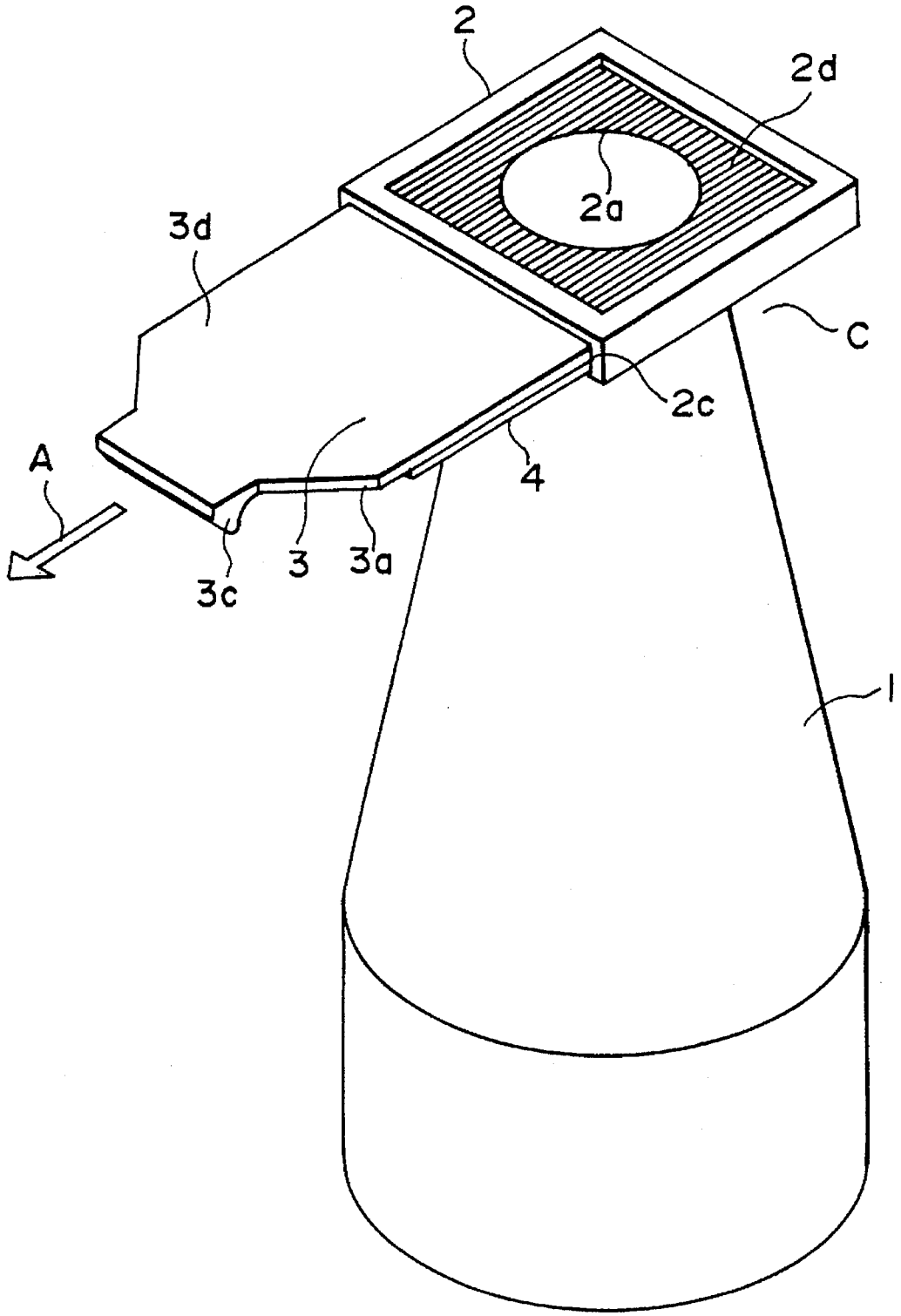
FIG. 2 is an external perspective view of the refill developer container illustrated in FIG. 1.
Figure 3:
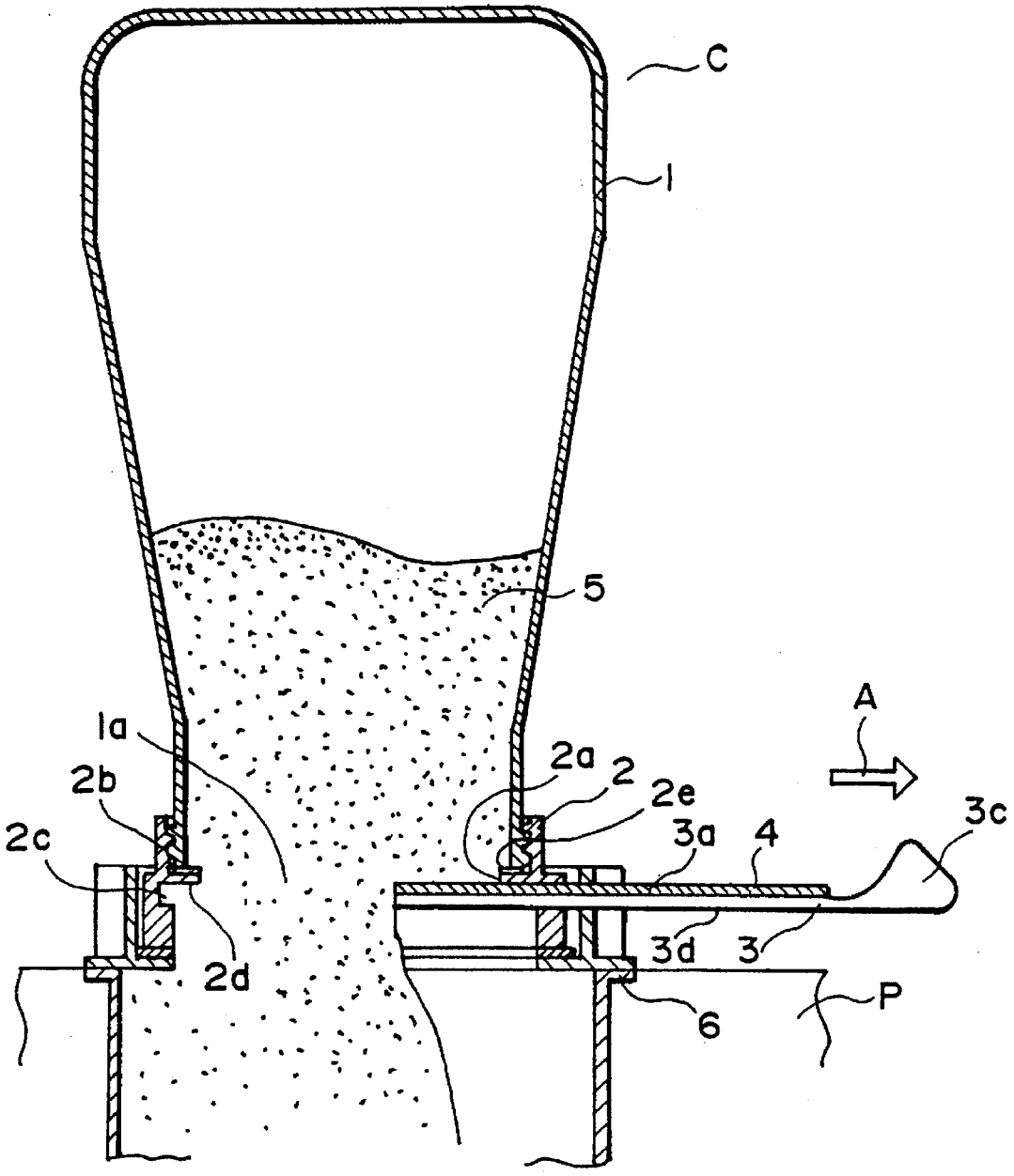
FIG. 3 is a sectional side view of the refill developer container, from which developer is being refilled into an image forming apparatus.
Figure 4A:
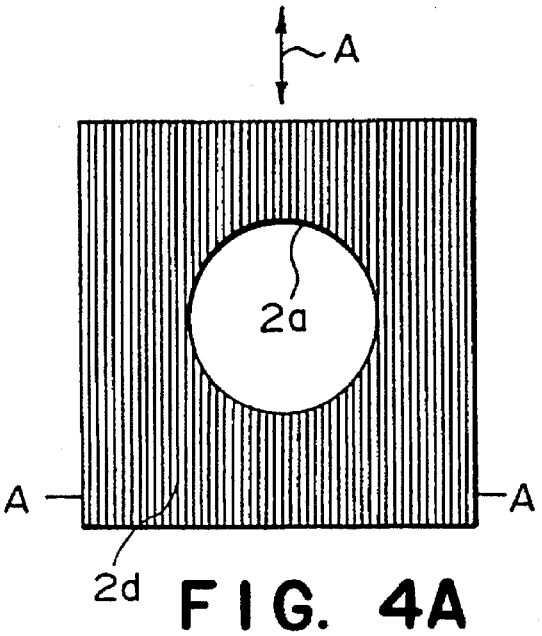
FIGS. 4(*a, b, c* and *d*) are plan views of the embodiments of the narrow portion of-the joint, and FIG. 4(*e*) illustrates the cross-section of FIGS. 4(*a, b, c* or *d*), at the sectional plane A—A, B—B, C—C or D—D, correspondingly.
Figure 4B:
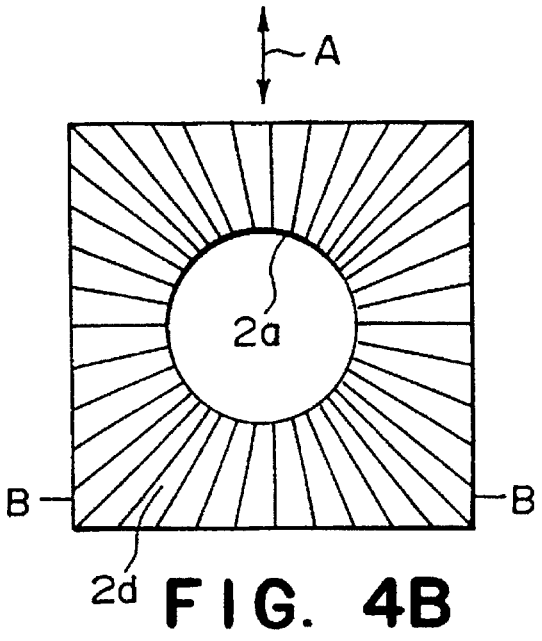
Figure 4C:
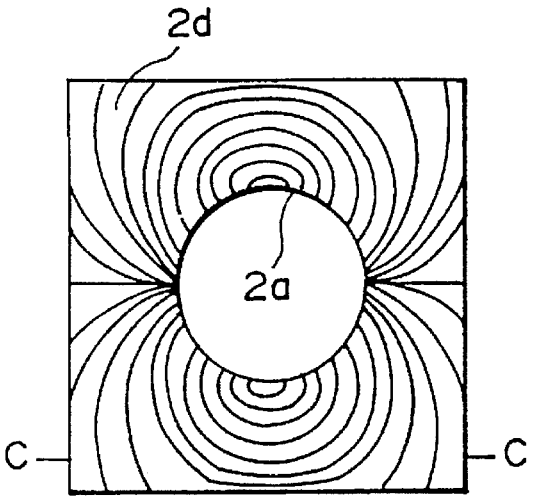
Figure 4D:
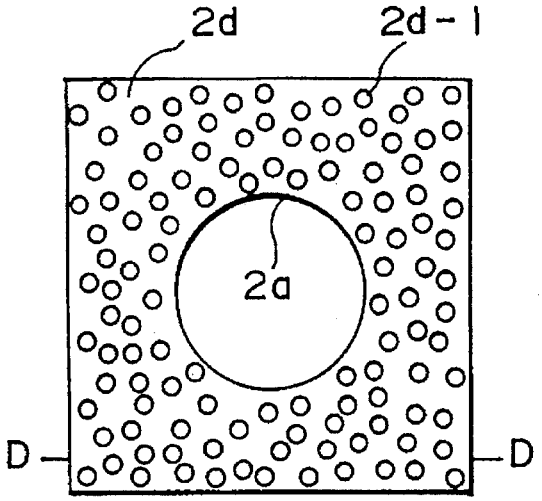
Figure 4E:
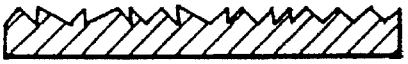

FIGS. 1, 2 and 3 illustrate the first embodiment of the refill developer container of the sliding shutter type in accordance with the present invention. FIG. 4 shows the seal member and sliding cap member, that is, the essential portions of the first embodiment of the present invention.

A refill developer container C has an opening 1*a* for refilling developer into a developer hopper 6 of the copying machine main assembly P, and comprises an actual container portion 1 for containing developer 5, a shutter member 3 for exposing or covering the opening la, and a cap member 2 as guiding means for guiding and supporting the shutter member 3 so that the shutter member 3 can take a closed position where it seals the opening 1*a*, and an open position to which it retracts from the closed position in order to expose the opening 1*a*. On the shutter member surface 3*a* facing the opening, an elastic seal member 4 is pasted. The cap member 2 has shutter guide portions 2*c* for guiding the shutter member 3 in the direction indicated by an arrow mark A in FIG. 2. They are disposed on both lateral sides of the cap member 3, relative to the sliding direction of the shutter member 3. The seal member 4 covers the area from the edge of the opening 1*a* to guide member 2*c*.

FIG. 4(*a*) is a plan view of the flange surface 2*b*, that is, the surface of the cap member 2, on which the seal member 4 slides. The flange surface 2*b* of the cap member 2, which is placed in contact with the seal member 4, is rendered uneven as shown in FIG. 4 to provide a recessed portion 2*d* as an air passage. Provision of easy air passage reduces the phenomenon that the flange surface 2*b* and seal member 4 stick to each other due to the suction effect which occurs between two members. In addition, it reduces the surface area on which the seal member 4 slides. Therefore, it is possible to reduce the force necessary to open or close the shutter member 3, that is, a shutter opening/closing resistance.

In order to reduce the suction cup effect generated between the seal member and the uneven flange surface 2*d*, the recessed portion 2*d* of the uneven flange surface 2*d* is preferred to be continuous and is connected to either the opening 1*a* of the actual container portion 1 or the external edge of the cap member 2, or both.

The recessed portion illustrated in FIG. 4(*a*) is constituted of a grooved surface. In this drawing, a large number of grooves are arranged substantially in parallel to the opening/closing direction of the shutter member 3.

Provision of plural recess portions substantially in parallel to the shutter opening/closing direction is very preferable in terms of reducing the shutter operating force, and simplifying the formation of the cap member 2.

FIG. 4(*b, c* and *d*) show other examples of the recessed portion of the uneven flange surface 2*d*: (b) radial grooves radiating from the developer refilling opening 2*a* of the cap member 2; (c) curved grooves; and (d) recessed portions connected among a large number of projections (islands) 2*d*-1 erected from the flat flange surface.

As the result of measuring the surface roughness created by these grooves or islands, the following conclusion was reached.

It is possible to effectively reduce the suction phenomenon induced between the seal member 4 and flange surface 2, when average distance Sm between adjacent peaks is 50–500 μm; center line average height Ra is 1–10 μm; ten point average height Rz is 5–70 μm; and maximum height Rmax is 20–150 μm. Further, when the above conditions are met, the developer 5 does not leak through the continuous recessed portion 2*d* even if the refill developer container C containing developer is subjected to a reasonable amount of impact as it is dropped. Therefore, provision of such grooves or islands is preferable.

Further, in order to reduce the force necessary to open or close the shutter member 3 by means of reducing the suction phenomenon induced between the seal member 4 and the flange surface 2*d*, and also, in order to reliably prevent the developer 5 from leaking upon impact when the container is dropped, it is preferable that the average peak-to-peak distance Sm is 100–300 μm; center line average height Ra is 2–6 μm; ten point average height Rz is 20–50 μm; and maximum height Rmax is 30–100 μm. Further, the configuration of the continuous recessed portion 2*d* is not limited to the aforementioned ones illustrated in FIGS. 4(*a, b, c* and *d*).

The seal member 4 is formed of soft elastic material. It is required to continue to seal between the cap member 2 and shutter member 3, so that the developer 5 contained in the actual container portion 1 is prevented from leaking from between the cap member 2 and shutter member 3 when the refill developer container is subjected to impact such as the one generated during an impact test or the like, and to reduce the opening/closing resistance of the shutter member 3 so that the shutter member 3 can slide with low resistance on the flange surface 2*b* of the cap member 2, which has the developer refilling opening 2*a*. More specifically, as the material for the seal member 4, sponge of silicon rubber, urethane, or the like, are usable. A preferable material would be high density polyurethane foam which has a hardness of 20° to 70°, a permanent compressive deformation ratio of 4% or less, a friction coefficient of 0.8 or less, a cell size of 60 μm to 300 μm, and a specific gravity of 0.2 to 0.5. It is preferable that such high density urethane foam is compressed by 5% to 50%, more preferably, 10% to 30%, when used.

Further, the seal surface is preferred to be flat, and to have as small a frictional resistance as possible. The seal member 4 must be glued to the shutter member 3 so as to yield enough adhesive strength to prevent it from being peeled or shifted on the shutter member 3. It is preferable that two components are integrally molded using the two color injection molding method.

The shutter member 3 is required not to be broken or twisted by the impact test such as a drop test. It is also required to display enough rigidity to evenly compress the seal member 4. Further, the sliding resistance created between the shutter member 3 and the cap member 2 needs to be small. As for specific material for the shutter member 3, the following materials can be listed: plastic resin such as polystyrene, polypropylene, and ABS; compound materials composed of a combination of the preceding plastic resin and glass fiber; and metallic material such as stainless steel or the like.

As shown in FIGS. 1–5, the cap member 2 is attached to the actual container portion 1. It has the opening 2*a* for refilling the developer 5 from the actual container portion 1 into the developer hopper 6 of the copying machine main assembly, and a U-shaped shutter guide portion 2*c* for guiding the opening/closing movement of the shutter member 3. Also, the cap member must be structured to keep the joint between itself and the actual container portion 1 sealed. As for the material for the cap member 2, the same material as the shutter member 3 can be considered.

When a test was conducted using polypropylene for the actual container portion 1, cap member 2, and shutter member 3, and a 2.5 mm thick foamed urethane (commercial name: BORON, product of INOAC KABUSHIKIKAISHA, JAPAN) for the sealing member 4, the seal member 4 was pasted to the shutter member 3, and then, the shutter member 4 was assembled into the cap member 2, in a manner to compress the seal member 4 by approximately 20%. The cap member 3 is unevenly surfaced, on the side which comes in contact with the seal member 4, in order to create the same degree of roughness as those surfaces illustrated in FIGS. 4(*a, b, c* and *d*). The surface roughness of the flange surface 2*b* is 180 μm to 190 μm in average peak-to-peak distance Sm, 3.5 μm to 4.0 μm in center line average height Ra, 34 μm to 40 μm in ten point average height Rz, and 50 μm to 60 μm in maximum height, for all surface configuration illustrated in FIGS. 4(*a, b, c* and *d*).

Five sets of the refill developer container C with the aforementioned structure were produced to measure the shutter opening/closing resistance. In the case of the refill developer container with no continuous recessed portions 2*d* on the flange surface 2*b* of the cap member 2, the average value of the shutter opening/closing resistance was 5 kgf, whereas when the flange was surfaced as shown in FIGS. 4(*a, b, c* and *d*), the average shutter opening/closing resistance values were 3.5 kgf, 3.9 kgf, 4.3 kgf, and 4.5 kgf, correspondingly.

In another test, a refill developer container C having the same structure and the continuous recessed portions 2*d* shown in FIG. 4(*a*) was produced to measure the difference in shutter opening/closing resistance. The results reveal that the suction phenomenon is reduced to effectively reduce the shutter opening/closing resistance, when the average peak-to-peak distance Sm is no less than 50 μm; the center line average height Ra is no less than 1 μm; the ten point average height Rz is no less than 5 μm; and the maximum height Rmax is no less than 20 μm. The results also reveal that the shutter opening/closing resistance is more effectively reduced when the average peak-to-peak distance Sm is no less than 100 μm; the center line average height Ra is no less than 2 μm; the ten point average height Rz is no less than 20 μm; and the maximum height Rmax is no less than 30 μm.

In another test, the refill developer containers C described above were dropped from a height of 60 cm at −5° C. to check the external developer leak from the refill developer container C through the continuous recessed portions 2*d*. The results confirmed that when the average peak-to-peak distance Sm was no more than 500 μm; the center line average height Ra was no more than 10 μm; the ten point average height Rz was no more than 70 μm; and the maximum height Rmax was no more than 150 μm, no external leak was observed, though a very slight amount of the developer 5 trickled out. Further, it was confirmed that when the average peak-to-peak distance Sm was no more than 300 μm; the center line average height Ra was no more than 60 μm; the ten point average height Rz was no more than 50 μm; and the maximum height Rmax was no more than 100 μm, not even the slightest amount of the developer 5 trickled out.

Figure 5:
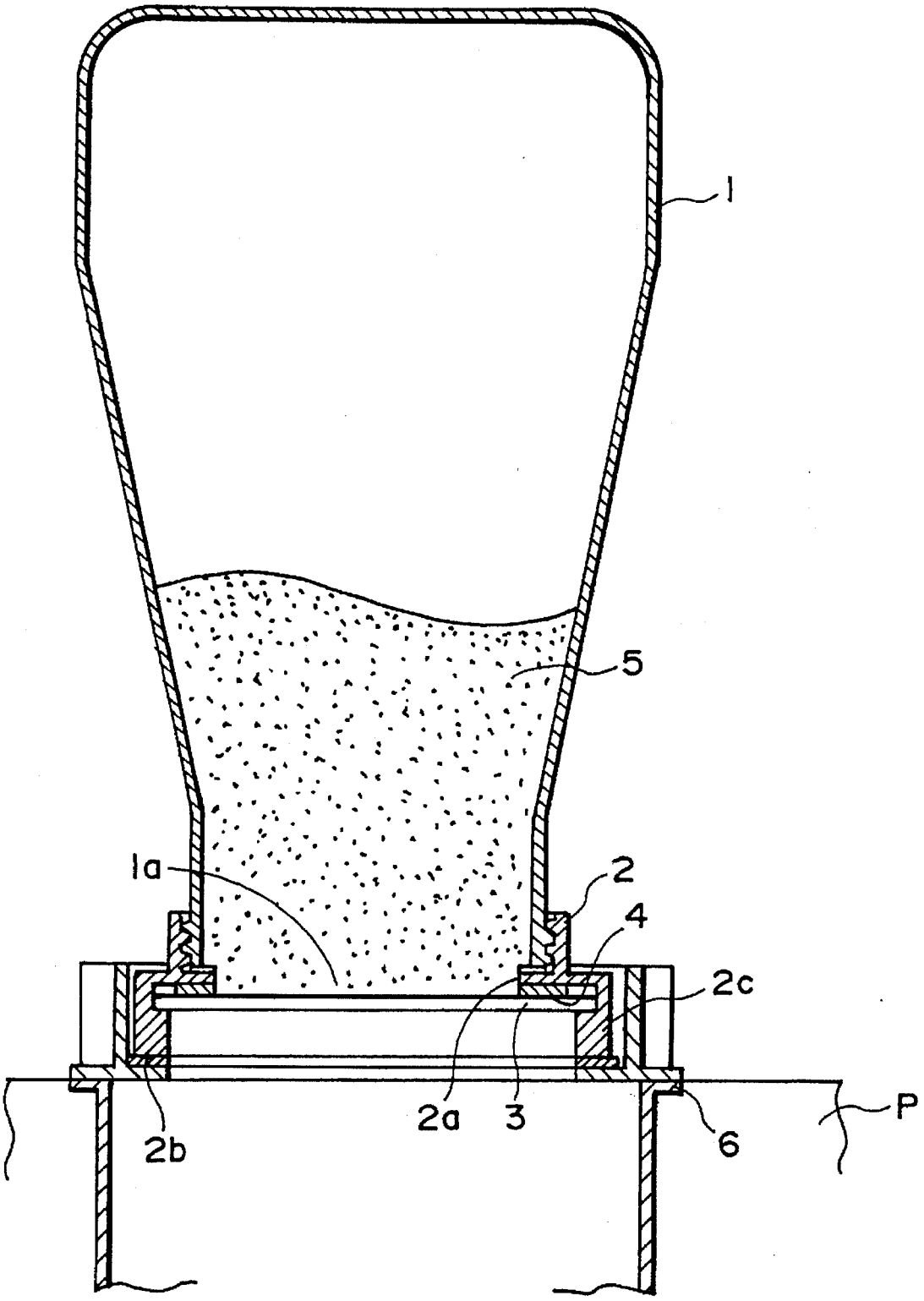
FIG. 5 is a sectional side view of the structure of a refill developer container given for comparison.

In these tests, the seal member 4 was attached to the shutter member 3, and the continuous recessed portions 2*d* were formed on the flange surface 2*b* of the cap member 2, on which the seal member 4 slides. However, the joint structure may be such that the seal member 4 is attached to the cap member 2, and the aforementioned continuous recessed portions 2*d* are formed on the shutter member surface on which the seal member 4 slides, as illustrated in FIG. 5. This arrangement also is effective to reduce the suction phenomenon.

However, when the continuous recessed portions 2*d* are formed on the flange surface 2*b* of the cap member 2, and the seal member 4 is pasted on the shutter member surface, in a manner of covering the area facing the flange surface 2*b*, and the area facing the opening 1*a* of the actual container portion 1, the seal member 4 is more firmly adhered to the shutter member 3, and the seal member 4 is compressed against the edge of the flange surface 2*b* (edge of the opening 2*a*), better sealing the joint between the shutter member 3 and flange surface 2*b*, even when the width of the flange surface 2*b* is narrow. Therefore, when the seal member 4 is pasted on the shutter member 3, the developer refilling opening diameter can be increased by approximately 10 mm, compared to when the seal member 4 is pasted on the cap member 2 as shown in FIG. 5. As a result, the time it takes to empty the developer 5 from the refill developer container C into the developer hopper 6, drops to approximately 15 seconds, making it possible to finish refilling the developer 5 into the copying machine main assembly P in half the time it takes in the case of the conventional container. Further, it become possible to fill the actual container portion 1 with the developer 5 more quickly, when the refill developer container C in accordance with the present invention is assembled. Therefore, the productivity is improved.

In another test, 100 refill developer containers C were subjected to an opening/closing test. In this case, the continuous recessed portions 2*d* were formed at the same time when the cap member 2 was molded using the injection molding method, and were arranged in parallel to the shutter opening/closing direction, as shown in FIG. 4(*a*), the average peak-to-peak distance Sm being 170 μm; the center line average height Ra being 2.7 μm; the ten point average height Rz being 27 μm; and the maximum height Rmax being approximately 165 μm. The shutter opening/closing resistance was approximately 3.3 kgf to 3.7 kgf, and the developer 5 in the refill developer container C could be refilled into the developer hopper 6, leaving almost none in the container C.

Further, the refill developer container in accordance with the present invention was subjected to a vibration test, a low pressure test, a drop test, and a high temperature/high humidity test, as a product distribution test. Each test was conducted using 10 refill developer containers C. An anomaly such as a developer leak or the like could not be observed in any of the above tests. Thereafter, the containers C were subjected to an image forming test, but no problem occurred; picture quality was excellent.

FIG. 3 illustrates how the developer 5 is refilled into the developer hopper 6 of the copying machine main assembly P, using the refill developer container C in accordance with the present invention. As illustrated in FIG. 3, as an operator pulls the shutter member 3 in the direction of an arrow mark A by grasping the knob 3*c* of the shutter member 3, the opening 1*a* is exposed so that the developer 5 in the actual container portion 1 drops through the opening 1*a* to refill the developer hopper 6. There are times when the developer hopper 6 becomes full before all the developer 5 in the container C is emptied into the developer hopper 6, and the operator closes the opening 1*a* by grasping the knob 3*c* of the shutter member 3 and moving the shutter member 3 in the direction opposite to the arrow A direction. Even in such cases, that is, when a refilling operation is completed as the developer 5 in the refill developer container C is only partially emptied, the opening 1*a* is sealed by the seal member 4 pasted in such a manner as to seal the joint between the shutter member 4 and cap member 2, preventing the developer 5 from leaking and scattering. Further, when the refill developer container C was separated from the developer hopper 6 after the developer 5 was refilled into the developer hopper 6 and the shutter member 3 was closed as described above, scattering of the developer 5 or the like could not be observed.

COMPARATIVE EXAMPLE 1

FIG. 1 is a longitudinal section of a comparative refill developer container, illustrating its structure. In this example, the seal member 4 was pasted on the cap member 4, at the bottom periphery portion of the developer refilling opening 2*a*, which required allowance for the pasting margin. As a result, the developer refilling opening became smaller by approximately 10 mm than the one in the first embodiment. Consequently, developer discharge efficiency was reduced, which resulted in prolonged developer discharge time. Further, the amount of the developer to be filled in the refill developer container had to be reduced by approximately 10% because of the longer filling time.

Embodiment 2

Next, the second embodiment of the present invention will be described.

In this embodiment, urethane rubber was used as the material for the seal member 4, and the seal member 4 was attached to the shutter member 3 by means of integrally forming the seal member 4 and the shutter member 3 using the two color injection molding method. Otherwise, this embodiment was the same as the first embodiment.

According to this embodiment, the seal member 4 does not need to be pasted to the shutter member 3; therefore, the number of production steps could be reduced, resulting in cost reduction.

Also in this embodiment, the opening test and product distribution test were conducted, but no problem occurred.

Embodiment 3

Next, the preferable properties of the shutter member 3 and seal member 4 will be described.

According to the preceding embodiments, the seal member 4 disposed between the shutter member 3 and cap member 2 of the refill developer container C of the sliding shutter type is pasted on the shutter member 3, on the surface facing the developer refilling opening 1*a* (FIGS. 1–3). By placing the the seal member 4 pasted to the shutter member 3 into the shutter guide portion 2*c* of the cap member 2, sealing properties are more stabilized, and also, the pasting margin of the cap member 2, on which the seal member 4 is to be pasted, becomes unnecessary. Therefore, it is possible to place the shutter guide portion 2*c* of the cap member 2 right next to the toner refilling opening 1*a*, further improving sealing properties. In addition, since the seal member 4 is pasted to the shutter member 3 when assembling the refill developer container C, the seal member 4 is compressed along the peripheral edge of the developer refilling opening 1*a*, that is, the edge between the opening 2*a* of the cap member 2, and the flange surface 2*b*, being elastically deformed by the edge which presses into the sealing member 4; therefore, sealing properties are further improved.

The seal member 4 is formed of soft elastic material. It is required to keep the joint between the cap member 2 and shutter member 3 sealed, so that the developer 5 in the refill developer container C is prevented from leaking out upon impact generated during the drop test or the like. At the same time, it is required to generate as small a frictional resistance as possible when it slides on the flange surface 2*b* of the cap member flange, which has the developer refilling opening 2*a*, so that the opening/closing resistance of the shutter member 3 can be reduced.

More specifically, a sponge of silicon rubber, urethane, or the like is used as the material for the seal member 4. Preferably, it is compressible low density polyurethane foam which has a hardness of 20° to 70°, a permanent compression deformation of no more than 4%, a friction coefficient of no more than 0.8, a cell size of 60 μm to 300 μm, and a specific gravity of 0.2 to 0.5.

As regards the compression of the seal member 4, it is preferable to increase compressibility and compressive stress to maintain a high level of sealing properties, in response to a recent tendency to increase the capacity of the refill developer container. In other words, if compressibility is small, compressive stress is also small, failing to provide satisfactory sealing properties; therefore, the developer 5 leaks during the drop impact test or the like. In particular, when the diameter of the developer refilling opening of a large capacity refill developer container or the like is large, the shutter member 3 are liable to deform upon drop impact or the like. Therefore, if the set value for the compressibility of the seal member 4 is small, sealing properties is liable to be instantly lost. Contrarily, if compressibility is excessively large, the compressive stress of the shutter member 4 also increases, improving thereby sealing properties, but at the same time, the shutter opening/closing resistance also increases. Therefore, sealing properties must be balanced against shutter opening/closing resistance. Thus, it is desirable that the compressibility and compressive stress of the seal member 4 is controlled so that they remain within a proper range.

According to this embodiment, the compressibility of the seal member 4 is preferred to be within a range of 5% to 50%, more preferably, a range of 20% to 40%. As to the compressive stress of the seal member 4, it is preferred to be within a range of 0.1 kg/cm$^2$ to 2.0 kg/cm$^2$, more preferably, a range of 0.6 kg/cm$^2$ to 1.5 kg/cm$^2$ (refer to JIS-K7220).

The surface of the seal member 4, that is, the surface which slides on the opposing member as the shutter is opened or closed, is preferred to be flat and have as small a frictional resistance as possible. In particular, when a single layer film made of polyester, polypropylene, polyamide (commercial name: nylon), polyethylene, fluoro-resin, or the like, or a compound layer film made of the preceding materials was applied to the surface of the seal member 4, the smoothness of the sliding surface was improved, whereby the shutter opening/closing resistance was effectively reduced. Further, when the aforementioned sliding film surface was coated with silicon oil, silicon wax, silicon coating, or the like in order to reduce the frictional resistance, the shutter opening/closing resistance could be further reduced.

The thickness of the film used in this embodiment is preferred to be no less than 4 μm and no more than 100 μm. When it exceeds 100 μm, the elasticity of the seal member 4 is liable to be suppressed by the rigidity of the film, failing to deliver satisfactory sealing properties. In terms of making the best use of the elasticity of the seal member 4, the film thickness is preferred to be no more than 50 μm. However, in terms of film production, it is rather difficult to produce, with consistency, film with a thickness of no more than 4 μm. Thus, in consideration of the above concern, as well as adhesiveness to the seal member, and film strength relative to sliding friction or the like, the film thickness is preferred to be no less than 10 μm.

The thickness of the layer of silicon oil or silicon wax coated on the film surface to reduce frictional resistance is preferred to be within a range of 0.05 μm to 2.00 μm. This is due to the following reasons. When the coating layer thickness is no more than 0.05 μm, the coating layer is not stable enough to function effectively, and when it is no less than 2 μm, it shows a tendency to be partially peeled by friction. Therefore, in order to deliver reliable friction reducing effects, and to prevent the separation of the coating layer, the coating layer thickness is preferable to be within a range of 0.1 μm to 0.5 μm.

The adhesive strength between the shutter member 3 and seal member 4 must be large enough to prevent the seal member 4 from being separated from the shutter member 3, or from being shifted thereon, when the shutter member 3 is opened or closed. If possible, the shutter member 3 and seal member 4 are desired to be integrally formed using the two color injection molding method.

The cap member 2 has an opening 2*a* for refilling the developer 5 from the actual container portion 1 into the developer hopper 6, and a substantially U-shaped shutter guide portion 2*c* for guiding the shutter member 3. It is necessary to be structured to keep sealed the joint between the actual container portion 1 and itself. As for the material for the cap member 2, it is possible to use plastic resin material such as polystyrene, polypropylene, ABS, and the like, glass-fiber- reinforced material comprising the preceding resins, metallic material such as stainless steel or the like.

The shutter member 3 is required not to break or become twisted when subjected to an impact test such as a drop test. It is also required to display enough rigidity to compress evenly the seal member 4. As described before, as the capacity of the refill developer container C is increased, the diameter of the toner filling opening (opening 2*a*) is also increased. Further, as the compressibility and compressive stress of the seal member 4 is increased, the shutter member 3, which supports the seal member 4, is deformed. Consequently, toner leak is liable to occur. Further, the shutter member 3 is in the form of a plate, and is liable to be more easily deformed than the cap member 2. Therefore, in order to prevent the shutter opening/closing resistance from increasing due to the shutter deformation, and also to prevent the occurrence of problems such as toner leak, it is desirable to provide the shutter member 3 with sufficient rigidity.

When the bending elasticity modulus of the shutter member 3 is small, the shutter member 3 becomes deformed, creating the aforementioned problems. Contrarily, when the bending elasticity modulus of the shutter member 3 is excessively increased, the shutter member 3 becomes brittle, being liable to develop cracks or break completely upon impact during product distribution or the like. Further, the number of materials having an extremely large bending elasticity modulus is small, and therefore, the cost of each material tends to be high.

Thus, according to this embodiment, the bending elasticity modulus of the shutter member 3 is also desired to be kept within a proper range. More specifically, it is preferable to be within a range of 20,000 kg/cm$^2$ to 100,000 kg/cm$^2$ more preferably, a range of 50,000 kg/cm$^2$ to 80,000 kg/cm$^2$ (refer to JIS-7203).

As for the material for the shutter member 3, it is desirable to be selected from among the materials of the same type as those for the cap member 2, on the premise given in the foregoing.

Further, in order to reduce the shutter opening/closing resistance, using the aforementioned means while maintaining satisfactory sealing properties, so that the operational properties of the refill developer container can be improved, it is preferable that material with low frictional resistance is coated on the shutter member 3, on the surface opposite to the surface on which the seal member 4 is pasted. In particular, when the diameter of the developer refilling opening of the large capacity refill developer container is large, the shutter member 3 and cap member 4 must be large, which increases the area on which the shutter member 3 slides as it is opened or closed. Therefore, coating low friction material is one of the most effective means for reducing the shutter opening/closing resistance.

The structure of the refill developer container C in this embodiment limits the choice of materials which can be coated on the surface of the seal member 4 in order to reduce its frictional resistance, since the surface of the seal member 4 remains directly in contact with the developer 5 until refilling occurs. In addition, there are other problems, such as peeling or cracking of the coated material. Further, after the film formed of low friction material is pasted on the seal member 4, the seal member 4 is liable to become deformed, delivering unsatisfactory sealing properties. Therefore, it is more desirable that the frictional resistance of the shutter surface 3*d*, which is the surface opposite to the surface 3*a* on which the seal member 4 is pasted, is reduced.

More specifically, according to this embodiment, such material as silicon oil, silicon resin, fluoro-resin, paraffinic waxes, ultra-high polymer polyethylene, or the like, is coated on the shutter surface 3*d* using means such as coating, pasting, spraying, or the like. Among them, silicon oil, which is coated, and silicic coating film, which is pasted, are preferable as easily processable low cost materials.

When coating the silicon oil on the shutter surface 3*d*, the viscosity and amount of silicon oil must be controlled. When the viscosity is excessively low, the shutter member 3 slides on the cap member in a pulsating manner as it is opened or closed, deteriorating the operational properties of the shutter. Contrarily, when the viscosity is excessively high, the material is difficult to coat on the shutter member 3. Therefore, according to the present invention, it is preferable to use the materials with a viscosity of 100 cSt to 10,000 cSt), more preferably, 1,000 cSt to 5,000 cSt.

As regards the amount of the coating material, when it is excessively small, a satisfactory oil film cannot be formed; therefore, the shutter opening/closing resistance cannot be effectively reduced. Contrarily, when the amount of the coating material is too much, the coated surface becomes sticky, allowing dust or developer to stick thereto.

Therefore, the amount of the coating material is preferable to be within a range of 0.01 mg/cm$^2$ to 0.5 mg/cm$^2$, more preferably, 0.05 mg/cm$^2$ to 0.1 mg/cm$^2$.

In this embodiment, 1.5 kg of developer 5 was filled in the actual container portion 1. The diameter of the developer refilling opening of the cap member 2 was set at 60 mm. As the material for the shutter member 3, polypropylene reinforced with glass fiber was used. The bending elasticity modulus of this material was approximately 52,000 kg/cm$^2$.

On the cap member surface in contact with the seal member 4, the same continuous recessed portions 2*d* as those in the first embodiment were formed, being aligned in parallel, in the opening/closing direction of the shutter member 3, as illustrated in FIG. 4(*a*). The average peak-to-peak distance Sm was 170 μm; the center line average height Ra, 2.7 μm; the ten point average height Rz, 27 μm; and the maximum height Rmax was approximately 165 μm.

As to the material for the seal member 4, the same material as Embodiment 1 was used. On the front surface (surface facing the cap member 2) of the seal member 4, a film was pasted, which was constituted of a 40 μm thick drawn polypropylene base film, and 0.2 μm thick silicic coat applied on the base film. Further, on the shutter surface 3*f*, which was the surface opposite to the surface on which the seal member was pasted, silicon oil was applied. Its viscosity was 3,000 cSt, and the coated amount was approximately 0.1 mg/cm$^2$.

Then, the shutter member 3 described above was assembled into the cap member 2 to complete the refill developer container C. During this process, the seal member 4 was compressed by approximately 23%, whereby a compressive stress of approximately 0.7 kg/cm2 was generated.

Next, the shutter opening/closing resistance was measured using 20 refill developer containers C structured as described above. It was approximately 2.0 kgf to 2.5 kgf, In a different test, instead of applying silicon oil to the shutter surface 3*d*, which is the surface opposite to the surface 3*a* on which the seal member 4 is pasted, a film was pasted, which was constituted of a 40 μm thick OPP base film, and silicic coat applied on the base film. Otherwise, the structure was the same as the preceding one. Twenty such refill developer containers C were produced to test the shutter opening/closing resistance. It was 2.1 kgf to 2.7 kgf, which was substantially the same as the one obtained using the preceding structure.

In another test, the shutter surface 3*d*, which is the surface opposite to the surface 3*a* on which the seal member 4 was pasted, was not treated at all. Otherwise, the structure was the same as the preceding one. Twenty such refill developer containers C were produced to measure the shutter opening/closing resistance. It was approximately 2.5 kgf to 3.5 kgf.

Next, twenty refill developer containers C were produced for each of the different structures, and were tested for developer refilling performance. In this test, practically all the developer 5 in the actual container portion could be refilled into the developer hopper 6, almost none of the developer 6 being left in the container C, and also, the shutter opening/closing resistance could be reduced as it could in the preceding embodiments. Also in this embodiment, the container C were subjected to the product distribution test and the image forming test, and no anomaly occurred.

Referring to FIGS. 1–3, the refill developer container C in accordance with the present invention will be described. The container C of this embodiment is in the form of a cartridge.

The flange surface 2*b* of the cap member 2, which comes in contact with the seal member 4, are provided with the continuous recessed portions 2*d* in the form of grooves. These grooves are formed when the cap member 2 is injection molded. The seal member 4 is cut out in a predetermined size from a sheet of seal member material. As for this sheet of seal member material, a double sided adhesive sheet is pasted on the side which faces the shutter member 3, leaving the separation sheet on the outward facing surface, and a sheet of flexible film is pasted, as needed, on the other side which comes in contact with the cap member 2. Then, after the separation sheet left on the double side adhesive sheet (tape) is peeled off, the seal member 4 is pasted on the shutter member 3, on the predetermined area. During this pasting process, it is preferable that a positioning jig is used to keep the positional accuracy within a range of ±0.1 mm. Next, a predetermined amount of silicon oil is uniformly coated, using cloth, paper, or the like, on the shutter member 4, on the surface 3*d*, which is the surface opposite to the side where the seal member 4 has been pasted. In this process, it is important to uniformly apply the oil so that the oil does not collect at the peripheral edges, apexes of the irregular surface, and the like, of the shutter member 3. In this embodiment, the silicon oil was applied after the seal member 4 was pasted on the shutter member 3. However, there will be no problem even if the seal member 4 is pasted after the silicon oil is coated on the shutter member 3.

The next step is a step in which the shutter member 3 is assembled into the shutter guide portion 2*c* of the cap member 2. In this step, it is preferable that a pressing jig is used to prevent the surface of the seal member 4 from being damaged, or to prevent the film pasted on the seal member surface from being damaged on the surface or edges, or being peeled. The pressing jig is manipulated through the opening 2*a* which is located between the cap member 2 and actual container portion 1. As the shutter member 2 is inserted all the way into the cap member 2, a cap unit is completed.

Figure 6:
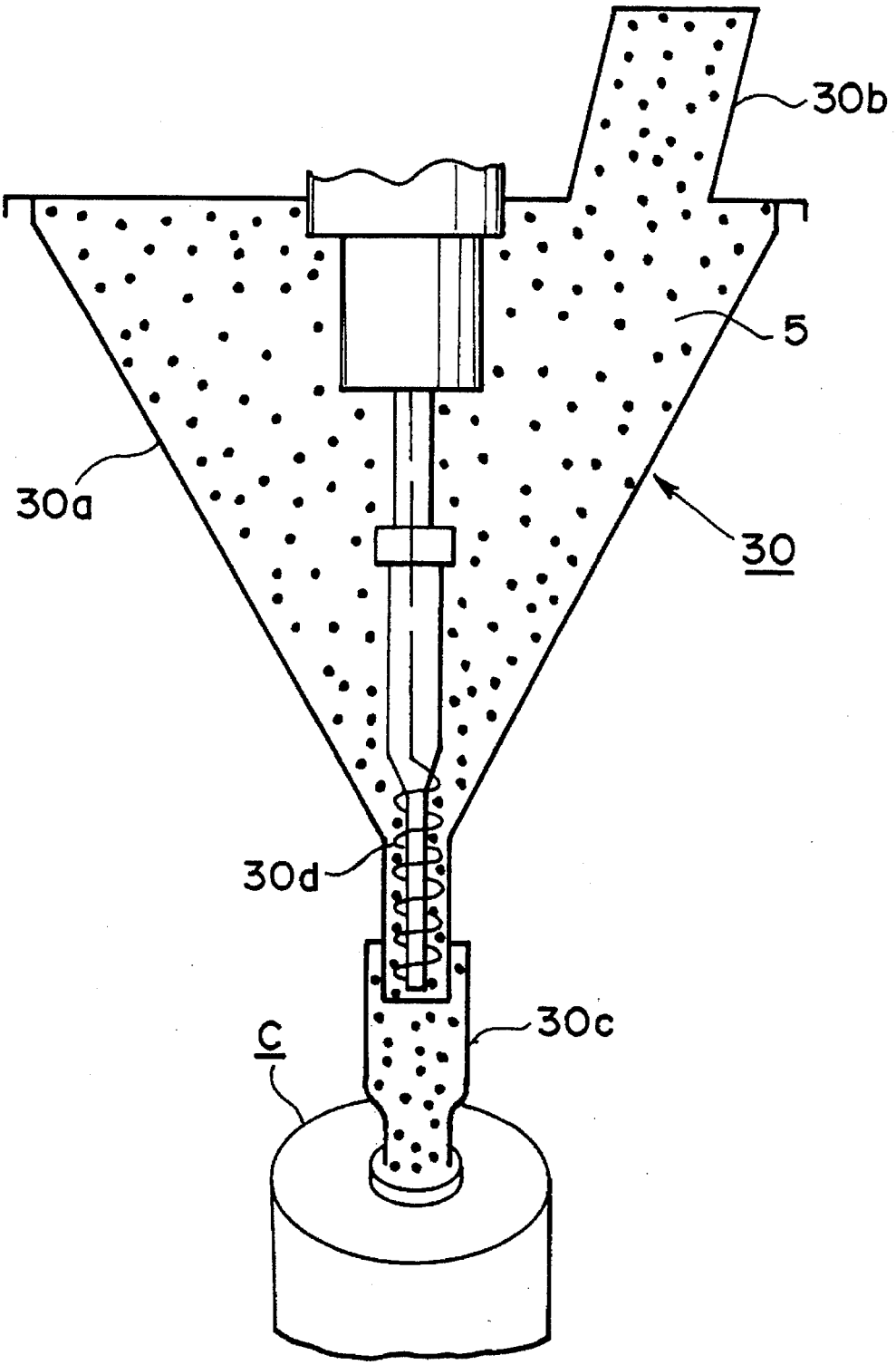
FIG. 6 is a schematic view of an auger type filling machine.
Figure 7:
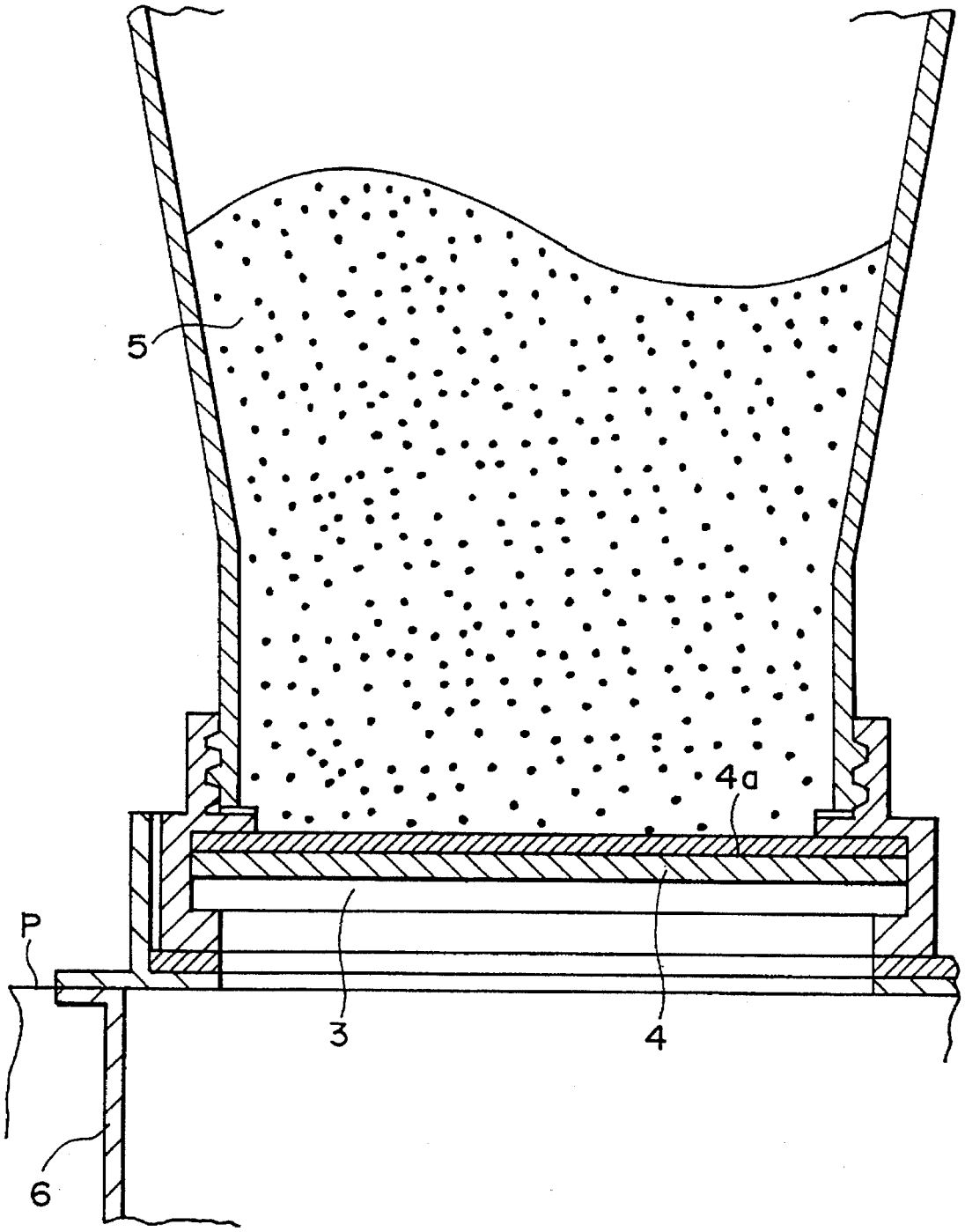
FIG. 7 is an enlarged sectional view of a portion of the refill developer container.

The following step is a step in which the developer 5 is filled into the actual container portion 1. Generally, an auger type filling machine 30 as shown in FIG. 6 is used. As an auger 30*d* is rotated, the developer 5 within a hopper 30*a*, which has been poured in through a chute 30*b*, is fed out of a discharge funnel 30, and filled into the refill developer container C. Instead of the auger type filling machine 30, a filling machine of different type, for example, a filling machine of the vibration feeder type, may be employed to fill the developer 5 into the refill developer container C. This will cause no problem.

After a predetermined amount of the developer 5 is filled, the aforementioned cap unit is fitted to the opening 1*a* of the actual container portion 1. In this embodiment, the external thread cut on the external peripheral surface of the cylindrical opening portion of the actual container portion 1 is screwed into the internal thread cut on the internal peripheral surface of the cylindrical portion integrally formed on the shutter guide portion 2*d* of the cap member 2.

In order to seal the joint between the actual container portion 1 and cap unit, an elastic member 2*e* of elastomer or the like is attached to the cap member surface facing the actual container portion 1, using the two color injection molding method. Then, two threads are tightened with a tool such as a torque wrench to yield a predetermined torque, completing the refill developer container C.

When the used refill developer container C is used again, the developer 5 is refilled into the actual container portion 1 by opening the shutter member 3, and then, the shutter member 3 is closed. Preferably, the following steps should be followed. First, the used refilled developer container C is disassembled into three pieces: the shutter member 3, cap member 2, and actual container portion 1. Then, after cleaning, they are examined for scratches, cracks, peeling, or the like. When none of the above anomalies are detected, they are reassembled into the refill developer container C, following the aforementioned steps, which start from the step for coating the silicon oil on the shutter surface 3*d*, which is the surface opposite to the side on which the seal member 4 is pasted.

The surface roughness in the embodiments of the present invention was measured using the following apparatus set to the specifications given below.

Measuring device: Surfcorder SE-3300 (available from Kosaka Kenkyusho, Japan)

| | |
|---|---|
| Speed: | 0.5 mm/s |
| Cutoff wave length: | 0.8 mm |
| Measurement length: | 25.0 mm |

The hardness of the seal member in the embodiments of the present invention, which was measured using the urethane foam hardness test (JIS K6401), was spring type A hardness.

While the invention has been described with reference to the structures disclosed herein, it is not confined to the details set forth, and this application is intended to cover such modifications or changes as may come within the purposes of the improvements or the scope of the following claims.

What is claimed is:

1. A developer container comprising:

a container portion having an opening through which developer is supplied in or out;

a shutter member for opening an closing the opening;

slide-guide means for guiding said shutter member;

a recess on a surface of said slide-guide means on which said shutter member slides, wherein said recess permits air flow.

2. A developer container according to claim 1, wherein said shutter member comprises a substrate, and an elastic member on said substrate to seal the opening.

3. A developer container according to claim 2, wherein said elastic member comprises a rubber layer, and a low friction layer applied on said rubber layer to allow smooth sliding of said shutter member.

4. A developer container according to claim 2, wherein said elastic member comprises high density polyurethane rubber.

5. A developer container according to claim 4, wherein the high density polyurethane rubber is 20° to 70° in hardness, no more than 4% in permanent compressive deformation, 60 μm to 300 μm in cell size, and 0.2–0.5 in specific gravity, and is compressed by 5% to 50% in use.

6. A developer container according to claim 5, wherein the high density polyurethane rubber is compressed by 20% to 40% in use.

7. A developer container according to claim 2, wherein the compressive stress of said elastic member is 0.1 $kg/cm^2$ to 2.0 $kg/cm^2$.

8. A developer container according to claim 7, wherein the compressive stress of said elastic member is 0.6 $kg/cm^2$ to 1.5 $kg/cm^2$.

9. A developer container according to claim 1, wherein a plurality of such recesses are provided and arranged in a moving direction of said shutter member.

10. A developer container according to claim 1, wherein said recess is continuous with at least one of the opening and the outside of said guide means.

11. A developer container according to claim 1, wherein said slide-guide means contacts with both surfaces of said shutter member, and said shutter member is treated for low friction resistance on the side opposite from the opening.

12. A developer container comprising:

a container portion having an opening through which developer is supplied in or out;

a shutter member for opening an closing the opening;

slide-guide means for guiding said shutter member;

a recess on a surface of said slide-guide means on which said shutter member slides, wherein an average peak interval Sm of the surface of said slide-guide means having said recess is 50 μm to 500 μm.

13. A developer container according to claim 12, wherein the average peak interval Sm is 100 μm to 300 μm.

14. A developer container comprising:

a container portion having an opening through which developer is supplied in or out;

a shutter member for opening an closing the opening;

slide-guide means for guiding said shutter member;

a recess on a surface of said slide guide means on which said shutter member slides, wherein a center line average height Ra of the surface of said slide-guide means having said recess is 1 μm to 10 μm.

15. A developer container according to claim 14, wherein the center line average height Ra is 2 μm to 6 μm.

16. A developer container comprising:

a container portion having an opening through which developer is supplied in or out;

a shutter member for opening an closing the opening;

slide-guide means for guiding said shutter member;

a recess on a surface of said slide-guide means on which said shutter member slides, wherein a ten point average roughness Rz of the surface of said slide-guide means having said recess is 5 μm to 70 μm.

17. A developer container according to claim 16, wherein the ten point average roughness Rz is 20 μm to 50 μm.

18. A developer container comprising:

a container portion having an opening through which developer is supplied in or out;

a shutter member for opening an closing the opening;

slide-guide means for guiding said shutter member;

a recess on a surface of said slide guide means on which said shutter member slides, wherein a maximum height Rmax of the surface of said slide-guide means having said recess is 20 μm to 150 μm.

19. A developer container according to claim 18, wherein the maximum height Rmax is 30 μm to 100 μm.

* * * * *

UNITED STATES PATENT AND TRADEMARK OFFICE

CERTIFICATE OF CORRECTION

PATENT NO. : 5,649,270 
DATED : July 15, 1997
INVENTOR(S) : Kazuhiko Omata et al It is certified that error appears in the above-identified patent and that said Letters Patent is hereby corrected as shown below:

COLUMN 2:
Line 46, "of-the" should read --of the--.

COLUMN 3:
Line 43, "show" should read --shows--; and
Line 49, "As the" should read --As a--.

COLUMN 4:
Line 61, "sealing" should read --seal--.

COLUMN 6:
Line 13, "become" should read --becomes--.

COLUMN 8:
Line 9, "are" should read --is--;
Line 11, "is" (second occurrence) should read --are--;
Line 14, "improving thereby" should read --thereby improving--; and
Line 19, "is" should read --are--.

COLUMN 9:
Line 47, "$kg/cm^2$" should read --$kg/cm^2$,--.

UNITED STATES PATENT AND TRADEMARK OFFICE

CERTIFICATE OF CORRECTION

PATENT NO. :5,649,270

DATED :July 15, 1997

INVENTOR(S) :Kazuhiko Omata et al

It is certified that error appears in the above-identified patent and that said Letters Patent is hereby corrected as shown below:

COLUMN 10:

Line 58, "3f" should read --3d--.

COLUMN 11:

Line 28, "were" should read --was--; and

Line 35, "are" should read --is--.

COLUMN 12 :

Line 36, "refilled" should read --refill--.

UNITED STATES PATENT AND TRADEMARK OFFICE

CERTIFICATE OF CORRECTION

PATENT NO. : 5,649,270

DATED : July 15, 1997

INVENTOR(S) : Kazuhiko Omata et al

It is certified that error appears in the above-identified patent and that said Letters Patent is hereby corrected as shown below:

COLUMN 13:

Line 5, "an" should read --and--; and
Line 48, "an" should read --and--.

COLUMN 14:

Line 12, "an" should read --and--;
Line 25, "an" should read --and--; and
Line 38, "an" should read --and--.

Signed and Sealed this

Twenty-sixth Day of May, 1998

*Attest:*

Bruce Lehman

BRUCE LEHMAN

*Attesting Officer*

*Commissioner of Patents and Trademarks*